148-139 AU 111 Ex
8/21/79 XR 4,165,407

United States Patent [19]

Endoh et al.

[11] 4,165,407

[45] Aug. 21, 1979

[54] ADAMITE ROLL MATERIAL FOR A ROLLING MILL

[75] Inventors: Toru Endoh, Nishinomiya; Masayuki Katoh, Amagasaki, both of Japan

[73] Assignee: Kubota, Ltd., Osaka, Japan

[21] Appl. No.: 810,472

[22] Filed: Jun. 27, 1977

[30] Foreign Application Priority Data

Jun. 25, 1976 [JP] Japan ..... 51/75906
Aug. 21, 1976 [JP] Japan ..... 51/99834

[51] Int. Cl.[2] ..... B32B 9/00

[52] U.S. Cl. ..... 428/408; 428/446; 428/539; 428/542; 148/138; 148/139; 29/148.4 D; 75/123 CB; 75/123 K

[58] Field of Search ..... 428/408, 446, 539, 542; 148/138, 139

[56] References Cited

U.S. PATENT DOCUMENTS

| | | | |
|---|---|---|---|
| 3,900,675 | 8/1975 | Olcott | 428/408 X |
| 3,925,577 | 12/1975 | Fatzer et al. | 428/446 X |
| 4,000,010 | 12/1976 | Sekimoto et al. | 148/138 |

FOREIGN PATENT DOCUMENTS 1069058 5/1967 United Kingdom

*Primary Examiner*—P. C. Ives
*Attorney, Agent, or Firm*—Wenderoth, Lind & Ponack

[57] ABSTRACT

Roll material which contains vanadium or similar elements able to form fine and evenly dispersed carbides which contribute to wear-resistance and in which network cementite produced is in a form which is easily dispersable, whereby the material, as well as being wear-resistant, is also less liable to surface roughness.

6 Claims, 20 Drawing Figures

ADAMITE ROLL MATERIAL FOR A ROLLING MILL

The present invention relates to adamite roll material for constituting the outer layer of a composite roll or roller in a rolling mill, such as produced by centrifugal casting process, for example, and employed for hot-strip or other heavy-duty rolling operations. More particularly, the invention relates to adamite roll material in which good solution or dispersion of network cementite is achieved, whereby the material has improved resistance to wear, toughness and surface roughness.

Adamite roll material applied to adamite rolls for hot rolling normally has iron, Fe, as the main component, 1.0–2.8% carbon, C, 0.3–1.5% silicon, Si, 0.3–1.5% manganese, Mn, 0.3–2.0% nickel, Ni, 0.5–2.0% chrominum, Cr, and 0.2–2.0% molybdenum, the material usually also containing trace impurities of phosphorus P, and sulfur, S, proportions indicated being percentages by weight, as are other proportions noted below. This constitution results in precipitation of cementite, with the result that the material has excellent wear resistance and toughness, and is therefore suited for construction of first-pass roughing rolls or finishing rolls in hot stripping mills, or roughing, intermediate, and finishing rolls for bar steel rolling. However, in the adamite material, the amount of contained carbon is greater than in the eutectic iron-carbon composition, and therefore, during cooling, as temperature falls subsequent to crystallization of primary austenite crystals, carbon in the austenite is precipitated as a proeutectoid network of cementite at grain boundaries, a portion being precipitated as acicular cementite, and it is difficult to effect solution in the austenite of this network cementite by subsequent diffusion heat treatment. As a result, forces imposed during use of adamite rolls cause split-off of the cementite and consequent surface roughness, weakness and shortened serviceability of the rolls.

Resistance of the rolls to wear in general and to effects leading to toughness and surface roughness can be improved if the network cementite is made fine and well-dispersed, and there have been various proposals for achieving this. According to one proposal, the amount of added carbon is reduced, in order to prevent precipitation of cementite at grain boundaries. However, this results in less formation of carbides, and therefore sufficient wear resistance cannot be achieved. It has also been proposed to avoid the abovenoted problem by cooling an adamite roll more rapidly subsequent to casting. However, since rolls must be large and thick to provide effective service in a rolling mill, there are limits to the permissible speed of cooling, and hence to the results achievable by this proposal. Alternatively, it has been suggested to disperse network cementite by heat treatment processes, but since the adamite contains around 1% Cr, dispersion of the network cementite is not easy, in addition to which an extra heat treatment process represents extra cost in production of rolls.

These problems are rendered more severe by the practice of manufacturing rolls by the centrifugal casting process, which, although generally considered the best method for roll manufacture, tends to lead to production of more cementite than other casting processes. Again, a certain amount of network cementite can be in effect eliminated by subsequent diffusion heat treatment, but if the roll material is maintained at a temperature high enough to effect completely satisfactory solution of the cementite in the austenite of the material, other properties of the material are adversely affected, and conventionally it has been considered that in practical terms ideal heat treatment curves are achieved in the known heat treatment processes, and that further improvement in properties of adamite rolls is difficult to expect.

In consideration of the abovenoted problems, the present invention provides an improved adamite roll material employed for adamite rolls or roller of a rolling mill in which network cementite is easily dispersed, whereby the material has outstanding wear resistance and resistance to forces liable to produce surface-roughness. According to the invention, depending on roll casting process, the amount of added chrome is brought to 0.8% or lower, as opposed to the value of 1% which is normal for adamite material, and one or more carbide forming elements, for example, titanium, Ti, zirconium, Zr, vanadium, V, tungsten, W, and niobium, Nb, are added to a total proportion of 0.3–3.5%. Carbon combines preferentially with these elements, whereby precipitation of an excessive amount of network cementite is prevented, the cementite formed with remaining carbon being almost entirely $Fe_3C$, which is easy to disperse, and nucleation of the carbides TiC, ZrC, etc. being separate from the formation of cementite. As a result the roll material as a whole has the same kind of toughness as low carbon material, and hence is not liable to surface roughness, but satisfactory wear resistance also is imparted to the material as a result of secondary hardening of the carbides formed with Ti, Zr, V, W or Nb, the total amount of said supplementary carbide forming elements being proportional to the combined amount of carbon and chromium in said materials. According to one preferred embodiment of the present invention there is provided roll mill roll material constituted by iron as the main component, carbon in the range from 1.4% to 2.8% by weight, silicon in the range of from 0.4% to 1.5% by weight, manganese in the range of from 0.4% to 1.5% by weight, nickel to an amount of 4.0% by weight or less, chromium to an amount of 0.5% by weight or less, molybdenum to an amount of 2.0% by weight or less, and one or more of the elements including vanadium, niobium, titanium, zirconium, and tungsten to a total amount in the range of from 0.3% to 3.0% by weight.

In another preferred embodiment of the present invention, adamite roll material for producing the outer layer of a compound roll, in which the outer layer is formed by centrifugal casting and then a central core portion is made integral with said outer layer in a centrifugal casting or stationary mold casting process, is constituted by carbon in the range of from 1.4% to 3.0% by weight, silicon in the range of from 0.4% to 1.5% by weight, manganese in the range of from 0.4% to 2.0% by weight, nickel in an amount up to 4.0% by weight, chromium in an amount up to 0.8% by weight, molybdenum in an amount up to 2.0% by weight, and one or more of the elements including vanadium, niobium, titanium, zirconium, and tungsten to a total amount in the range of from 0.5% to 3.5% by weight, the remainder of said material being substantially iron.

The invention will now be described in further detail, in reference to the attached drawings and photographs, in which FIGS. 1 through 6 are microphotographs at a magnification of 60 times showing structure of comparison examples of roll mill roll material, FIG. 1 showing a standard adamite roll material containing 1% chromium, FIG. 2 to FIG. 6 respectively showing material in which 0.5%, 1%, 1.5% 2.0%, 2.5% addition of vanadium are made to the material of FIG. 1;

Figure 9:
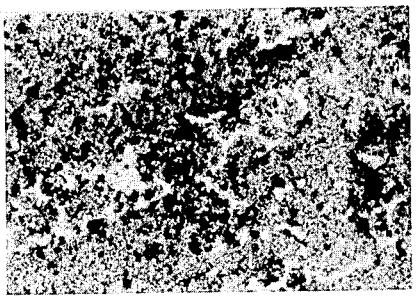
Figure 12:
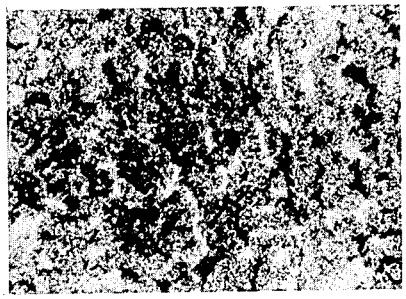
Figure 10:
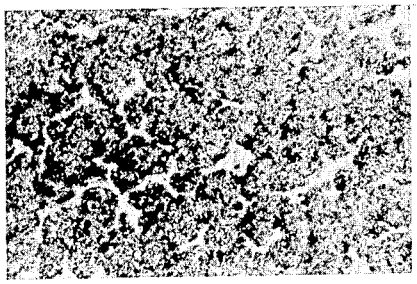
Figure 13:
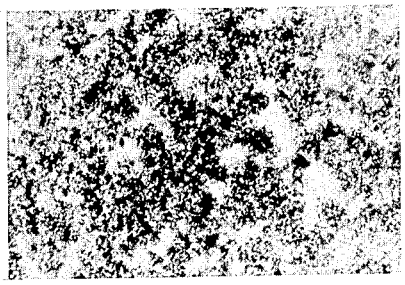
Figure 18:
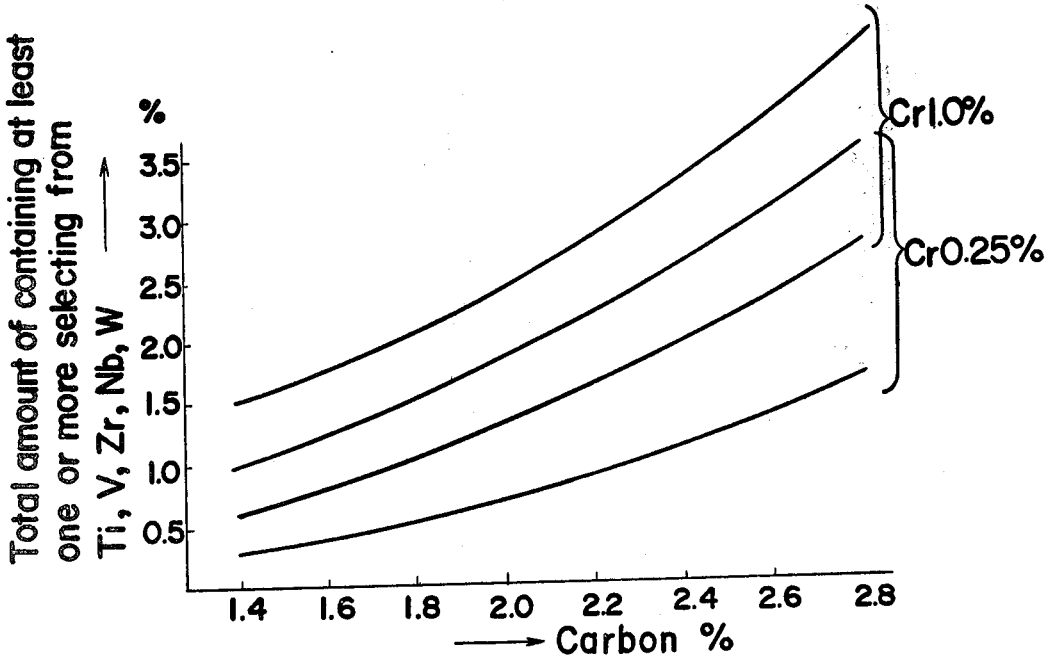
Figure 14:
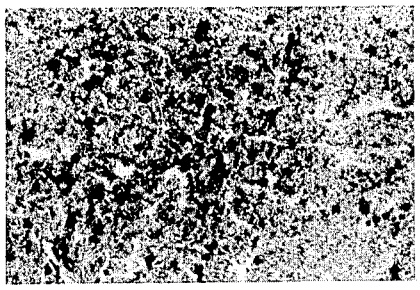
Figure 17:
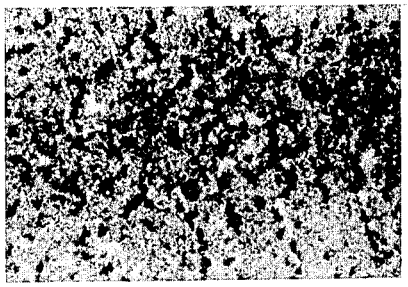
Figure 15:
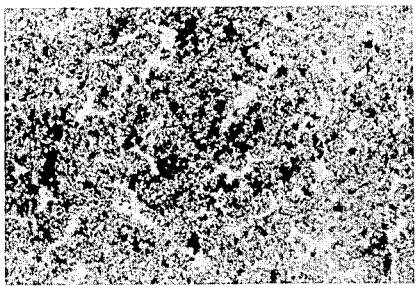
Figure 19:
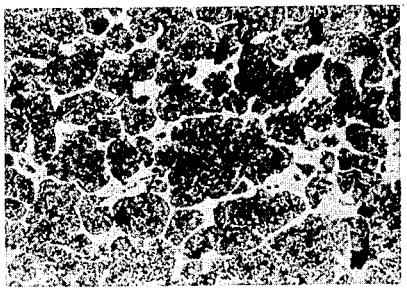
Figure 16:
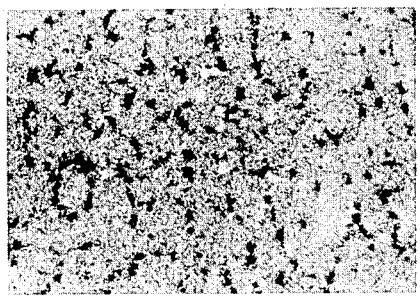
Figure 20:
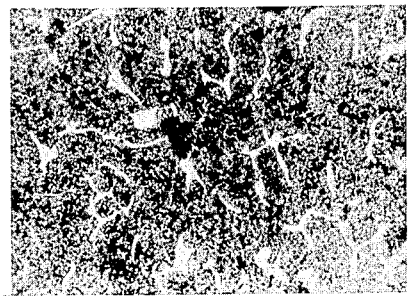

FIGS. 9 through 17 are microphotographs at a magnification of 65 times of structure of roll mill roll material with which rolls are produced by centrifugal casting process, FIG. 9 showing a standard adamite roll material containing 1% chromium, FIGS. 10, 11, 12 and 13 respectively showing material in which 0.5%, 1%, 1.5%, and 2.5% additions of vanadium are made to the material of FIG. 9, FIG. 14 showing material containing 0.25% chromium and 0.5% vanadium, FIG. 15 showing material containing 0.5% chromium and 0.5% vanadium, FIG. 16 showing material containing 0.25% chromium and 1% vanadium, and FIG. 17 showing material containing 0.5% chromium and 1% vanadium;

FIG. 18 is a graph showing the relation between roll material carbon content and the amount of supplementary carbide-forming elements required to achieve efficient dispersion of cementite when the chromium content of the roll material is of the order of 0.25% and 1.0% and rolls are produced by centrifugal casting process; and FIGS. 19 and 20 are microphotographs at a magnification of 65 times, respectively showing structure of conventional adamite roll material and roll material according to the invention in which vanadium content is 1% and chromium content 0.25% and the rolls are produced by centrifugal casting process.

A first set of adamite roll samples 1–7 was produced by casting adamite material in blocks of AY types and then heat treating the castings at 980° C. for 6 hours. Composition of Samples 1–7 is shown in Table 1, the balance of percentages by weight, not indicated in the Table, being Fe in each sample.

Table 1

| | Chemical Composition of Test Samples 1–7 | | | | | | | | | |
|---|---|---|---|---|---|---|---|---|---|---|
| Sample No. | C | Si | Mn | P | S | Ni | Cr | Mo | V | Fe |
| No. 1 | 1.92 | 0.63 | 1.02 | 0.026 | 0.021 | 1.17 | 1.01 | 0.63 | tr | remainder |
| No. 2 | 1.89 | 0.59 | 0.99 | 0.024 | 0.018 | 1.19 | 0.98 | 0.61 | 0.52 | " |
| No. 3 | 1.87 | 0.58 | 0.98 | 0.022 | 0.019 | 1.17 | 1.03 | 0.58 | 0.97 | " |
| No. 4 | 1.91 | 0.62 | 1.01 | 0.023 | 0.020 | 0.99 | 0.60 | 1.48 | " | |
| | | | | | 1.15 | | | | | |
| No. 5 | 1.92 | 0.60 | 1.03 | 0.025 | 0.018 | 1.17 | 1.04 | 0.62 | 2.03 | " |
| No. 6 | 1.88 | 0.64 | 1.00 | 0.024 | 0.019 | 1.13 | 1.06 | 0.64 | 2.51 | " |
| No. 7 | 1.90 | 0.57 | 0.98 | 0.029 | 0.017 | 1.16 | 0.24 | 0.58 | 0.45 | " |

Figure 1:
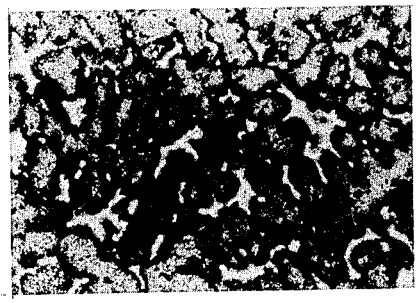
Figure 4:
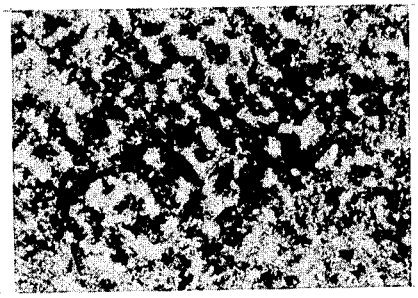
Figure 2:
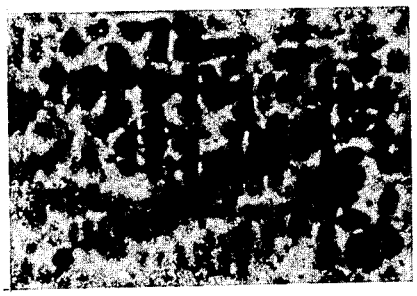
Figure 5:
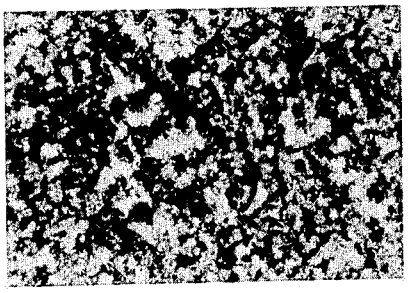
Figure 3:
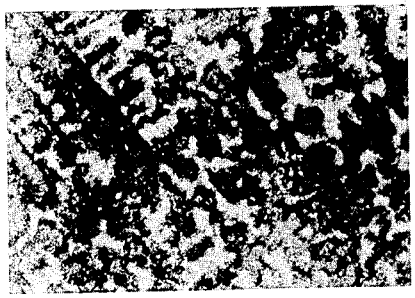
Figure 6:
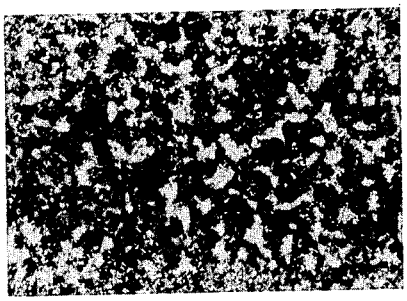
Figure 7:
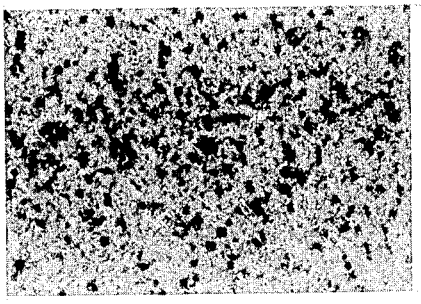
FIG. 7 is a microphotograph at a mangification of 60 times showing structure of roll mill roll material according to the invention.
Figure 11:
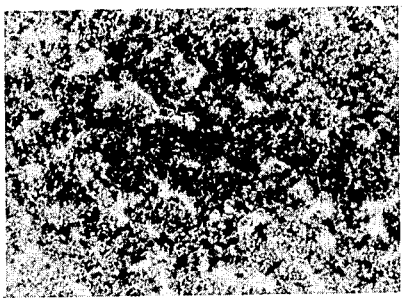

Sample 1 is a representative example of conventional adamite material containing 1% Cr, and Samples 2–6 are examples of adamite material which have a composition similar to that of Sample 1, but in which an addition of a carbide-forming element in the form of vanadium is increased by about 0.5% in successively numbered samples. Structure achieved with compositions of Samples 1, 2, 3, 4, 5, 6, and 7 is shown in FIGS. 1, 2, 3, 4, 5, 6, and 7, respectively, cementite being apparent as the white portions of the photographs. Sample 1 is a typical example of conventional roll material, which as seen from FIG. 1 results in very uneven dispersion of cementite, and hence easy occurrence of surface roughness in rolls. From FIGS. 2–6 it is seen that when chromium content is kept at around 1%, the necessary addition of vanadium to effect suitable dispersion of cementite is 1.0–2.5%, as in Samples 3–6. However, even better dispersion of cementite is achieved if the amount of chromium is reduced to 0.25% and the amount of vanadium is made about 0.5%, as shown in FIG. 7. In the material of FIG. 7, chromium is well dissolved in network cementite, which consists almost entirely of $Fe_3C$, since the amount of chromium is small, and is well dispersed throughout the material, whereby risk of separation of conglomerations of cementite from the rest of the material and surface roughness is greatly reduced, while requisite wear resistance is imparted to the material by fine, well-dispersed carbides of vanadium, which form separately from the cementite.

Figure 8:
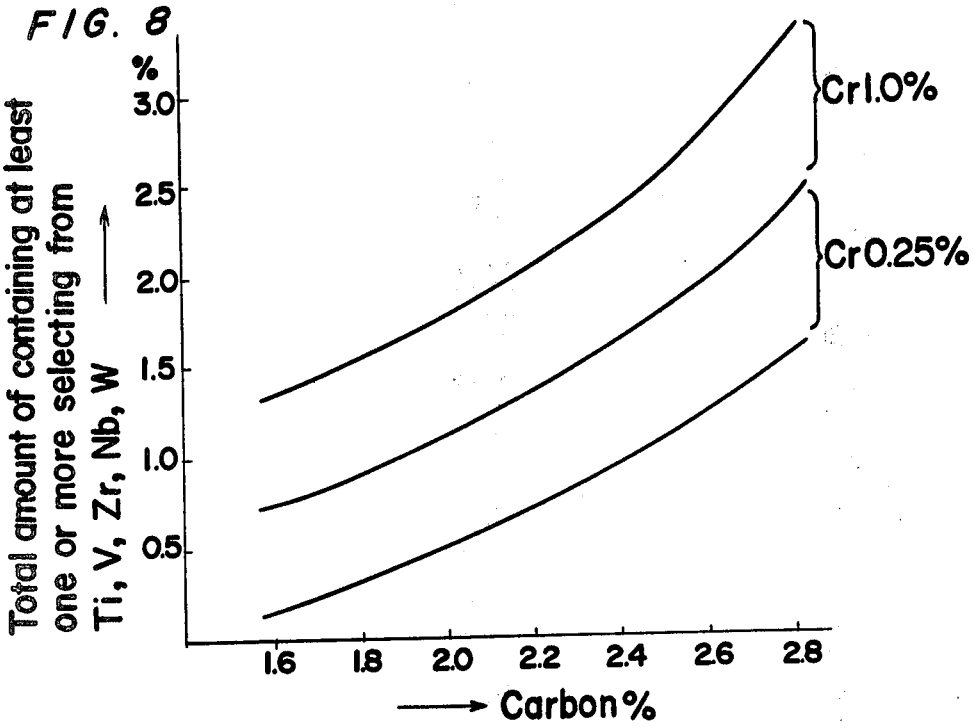
FIG. 8 is a graph showing the relation between roll material carbon content and the amount of supplementary carbide forming elements required to achieve efficient dispersion of cementite when the chromium content of the roll material is of the order of 0.25% and 1.0%, and a stationary casting mold is used for production of rolls.

In general, the total amount of titanium, vanadium, zirconium, tungsten, niobium or similar carbide-forming element alone or in combination which must be added to achieve good dispersion of cementite in adamite material is relative to and increases with incresing value of the combined total addition of carbon and chromium. This is illustrated in FIG. 8, which plots values that apply when a stationary mold is used for production of rolls, and from which it is seen that the amount of additional carbide forming material should be in the range 0.3–3% in order to achieve satisfactory dispersion of cementite in adamite roll material, when carbon content of the material is in the range 1.6–2.8% and chromium content is of the order of 0.25% and 1.0%. It is seen that for any given chromium content the plot of the required addition of carbide-forming element or elements gives the same curve, and the required addition increases with increased carbon content.

Reference is now made to FIGS. 9, 10, 11, 12, 13, 14, 15, 16, and 17 which are microphotographs of magnification x65 and respectively show structures obtained in Samples 8, 9, 10, 11, 12, 13, 14, 15, and 16 produced by centrifugal casting process and having the compositions indicated with percentages by weight as shown in Table 2.

Table 2

| | Chemical Composition of Test Samples 8–16 | | | | | | | | | |
|---|---|---|---|---|---|---|---|---|---|---|
| Sample No. | C | Si | Mn | P | S | Ni | Cr | Mo | V | Fe |
| No. 8 | 1.94 | 0.60 | 1.02 | 0.028 | 0.017 | 1.21 | 1.05 | 0.57 | 0 | remainder |
| No. 9 | 1.99 | 0.57 | 0.98 | 0.023 | 0.016 | 1.19 | 1.01 | 0.58 | 0.49 | " |

Table 2-continued

| Chemical Composition of Test Samples 8-16 | | | | | | | | | | |
|---|---|---|---|---|---|---|---|---|---|---|
| Sample No. | C | Si | Mn | P | S | Ni | Cr | Mo | V | Fe |
| No. 10 | 1.91 | 0.61 | 1.03 | 0.025 | 0.015 | 1.17 | 1.03 | 0.57 | 0.97 | " |
| No. 11 | 1.95 | 0.61 | 0.97 | 0.027 | 0.019 | 1.20 | 1.04 | 0.56 | 1.53 | " |
| No. 12 | 1.91 | 0.64 | 1.00 | 0.024 | 0.019 | 1.16 | 1.06 | 0.62 | 2.46 | " |
| No. 13 | 1.91 | 0.57 | 0.99 | 0.023 | 0.017 | 1.17 | 0.24 | 0.57 | 0.45 | " |
| No. 14 | 1.96 | 0.60 | 0.97 | 0.022 | 0.018 | 1.19 | 0.47 | 0.61 | 0.51 | " |
| No. 15 | 1.95 | 0.61 | 1.00 | 0.026 | 0.019 | 1.21 | 0.24 | 0.60 | 0.98 | " |
| No. 16 | 1.91 | 0.58 | 1.03 | 0.025 | 0.015 | 1.17 | 0.55 | 0.57 | 1.01 | " |

Samples 8–16 were prepared by centrifugal process, there being employed in each case 60 Kg of molten metal which was poured into a mold having an internal diameter of 280 mm and depth of 220 mm and rotated at 880 rpm, and each casting subsequently receiving heat treatment in which it was held at 980° C. for 6 hours. These samples were adamite roll material such as employed in manufacture of composite rolls by a centrifugal process in which first an outer layer of highly wear resistive material is formed by centrifugal casting and then a core portion is made integral with the outer layer by being poured into a central opening defined thereby, either by centrifugal casting process or by pouring into a stationary mold in which the outer layer is positioned, said composite roll being used either as a roughing roll or forward finishing roll in hot strip mill or as a roughing roll, middle roll or finishing roll in strip mill.

Sample 8 is a conventional adamite material containing about 1.0% chromium and no supplementary carbide-forming elements such as noted above. Samples 9, 10, 11, and 12 contain vanadium addition of the order of 0.5%, 1.0%, 1.5%, and 2.5%, respectively, chromium content being of the order of 1.0% and carbon content of the order of 1.9%. From FIGS. 10–13 it is seen that Samples 9–12, and particularly Samples 10–12 give much improved dispersion of cementite.

In Sample 13, whose structure is shown in FIG. 14, carbon content is maintained at about 1.9%, while vanadium content is reduced to less than 0.5% and a corresponding reduction of chromium content to about 0.25%.

For Sample 9–12 in which chromium content is around 1.0% it is seen that an addition of vanadium of the order of 1.0% is necessary in order to achieve good dispersion of cementite. On the other hand when chromium content is reduced to about 0.25%, as in Sample 13, the vanadium addition need only be about 0.5% or less in order to achieve good dispersion of cementite. A 0.5% addition of vanadium also shows results with respect to dispersion of cementite when chromium content is of the order of 0.5%, as seen from FIG. 15 showing structure of Sample 14.

In Samples 15 and 16 vanadium content is around 1% in both cases and chromium content is respectively about 0.25% and 0.5%, and network cementite becomes easily dispersed, since it is largely $Fe_3C$, as noted above.

In terms of overall composition, the amount of carbon is of course important, and for centrifugally cast material also a balance should be maintained between the total amount of added carbide-forming elements and the total amount of added carbon and chromium, the general relation when adamite roll material is cast by centrifugal process being shown in FIG. 18, which is similar to FIG. 8. In FIG. 18 it is seen that required addition of carbon-forming alloys for different amounts of carbon content of roll material when chromium content is of the order of 0.25% and 1.0% varies in generally the same way for roll material cast by centrifugal process as for roll material cast in stationary process, but that the upper and lower limits of the range of carbide-forming element addition is slightly higher for material cast by entrifugal process, this probably being because of the tendency for more cementite to form in the centrifugal casting process.

On the basis of results obtained with Samples 2–7 and 9—16, and samples for which composition requirements are plotted in FIGS. 8 and 18, preferred ranges of proportions of components of adamite roll material, and reasons for these preferred ranges are as follows.

C: 1.4–3.0%

Precipitation of carbon in cementite or in the form of other carbides is an important factor contributing to wear resistance, proeutectoid cementite (network cementite) being particularly important in this respect. When a centrifugal casting process is employed and vanadium or similar carbide-forming elements are added, at least 1.4% C is necessary in order to achieve precipitation of an effective quantity of network cementite. On the other hand, addition of more than 3.0% C results in excessive production of cementite and hence lowered toughness and resistance to effects liable to cause surface roughness.

Si: 0.4–1.5%

At least 0.4% silicon is necessary for deoxidation, but toughness is lowered for silicon addition in excess of 1.5%.

Mn: 0.4–2.0%

Similarly to silicon, manganese must be included to an amount not less than 0.4% in order to achieve requisite deoxidation. On the other hand, 2.0% addition is the upper limit since a greater addition of manganese results in lowered toughness of the material.

Ni: 4.0% or less

Nickel is a necessary element for improvement of wear resistance and toughness, but is kept to 4.0% or less, since greater addition thereof results in formation of an excessive amount of bainite.

Cr: 0.8% or less for roll material cast by centrifugal process; 0.5% or less for material cast in stationary molds.

Chromium contributes considerably to improvement of wear resistance when contained in cementite, which then has the formula $(Fe, Cr)_3C$. However, as noted above, it is desirable to avoid formation of excessive network cementite, which is difficult to disperse in heat treatment. If the proportion of chromium is kept below the abovenoted values there is practically no precipitation of network $(Fe, Cr)_3C$, and network cementite is almost entirely $Fe_3C$, which may be easily dispersed by heat treatment, complementary improvement to wear resistance being achieved by the carbides formed as a result of addition of the abovementioned carbide-forming elements. Also, by keeping the amount of chromium comparatively low, required addition of supplementary carbide-forming elements is less, as may be seen from FIGS. 8 and 18.

Mo: 2.0% or less

Molybdenum is very effective in improving hot strength and hardenability and preventing temper brittleness, but additions thereof in excess of 2.0% are increasingly less effective in improving qualities of the roll material and render the material much more expensive.

V, Nb, Ti, Zr, W alone or in combination:0.3–3.5% in roll material cast by centrifugal process; 0.3–3.0% for material cast in stationary molds.

Addition of these elements results in preferential formation of the carbides VC, NbC, TiC, ZrC, or WC, so resulting in low carbon content in the main portion of the alloy constituting the roll material, and in improved toughness, as noted earlier.

Thus, the invention offers the advantage that concentrated precipitation of network cementite liable to result in surface roughness of rolls is avoided, but required strength for heavy duty work is achieved by finely dispersed carbides of vanadium or similar material.

The remainder of the roll material is iron, and trace impurities of sulfur and phosphorus, which of course, are desirably kept to a minimum.

FIGS. 19 and 20, which are microphotographs at a magnification of ×65, further illustrate the advantages of the invention. FIG. 19 shows the structure of conventional adamite material prepared as the outer layer of an actual roll and having the composition shown by Sample A in Table 3, in which percentages are by weight, and FIG. 20 shows the structure of Sample B of Table 3, which is a material according to the invention and was also used in manufacture of an actual roll.

Table 3

| Sample No. | C | Si | Mn | P | S | Ni | Cr | Mo | V | Fe |
|---|---|---|---|---|---|---|---|---|---|---|
| | Chemical Composition of Actual Roll Material of Samples A and B (%) | | | | | | | | | |
| No. A | 1.97 | 0.57 | 1.05 | 0.027 | 0.023 | 1.17 | 1.03 | 0.61 | — | remainder |
| No. B | 1.99 | 0.61 | 1.02 | 0.028 | 0.021 | 1.19 | 0.23 | 0.57 | 1.13 | " |

Both samples A and B were cast in a centrifugal mold rotated at 550 rpm and having an internal diameter of 750 mm and length depth of 2500 mm, to form roll outer layers 80 mm thick, which were heat-treated at 980° C. for 6 hours subsequent to casting. It is seen that dispersion of cementite is much more marked in the material of the invention than in conventional material, based on a comparison between FIG. 19 and FIG. 20.

Although the present invention has been fully described by way of example with reference to the attached drawings, it should be noted that various changes and modifications are apparent to those skilled in the art. Therefore, unless such changes and modifications depart from the scope of the present invention, they should be construed as included therein.

What is claimed is:

1. Roll-mill roll material consisting of carbon in the range of from 1.4% to 3.0% by weight, silicon in the range of from 0.4% to 1.5% by weight, manganese in the range of from 0.4% to 2.0% by weight, nickel to an amount of 4.0% by weight or less, chromium to an amount of 0.8% by weight or less, molybdenum to an amount of 2.0% by weight or less, and one or more carbide forming elements selected from vanadium, niobium, titanium, zirconium, and tungsten to a total amount in the range of from 0.3% to 3.5% by weight, the remainder of said material being substantially iron, with the proviso that (1) the total amount of carbide forming elements is proportional to the combined total amount of carbon and chromium, and (2) the total amount of carbide forming elements increases with increasing combined total amounts of carbon and chromium.

2. Roll-mill material as defined in claim 1, wherein said carbon is in the range of from 1.4% to 2.8% by weight, said manganese is in the range of from 0.4% to 1.5% by weight, said chromium is in the range of 0.5% by weight or less, and said total amount of one or more elements selected from vanadium, niobium, titanium, zirconium, and tungsten is in the range of from 0.3% to 3.0% by weight.

3. Roll-mill roll material as defined in claim 1, wherein the one or more carbide forming elements are selected from niobium, titanium, zirconium and tungsten.

4. Roll material as defined in claim 1, wherein the outer layer of a compound roll, in which the outer layer is formed by centrifugal casting and then a central core portion is made integral with said outer layer in a centrifugal casting or stationary mold casting process, is constituted by carbon in the range of from 1.4% to 3.0% by weight, silicon in the range of from 0.4% to 1.5% by weight, manganese in the range of from 0.4% to 2.0% by weight, nickel in an amount up to 4.0% by weight, chromium in an amount up to 0.8% by weight, molybdenum in an amount up to 2.0% by weight, and one or more elements selected from vanadium, niobium, titanium, zirconium, and tungsten in a total amount in the range of from 0.5% to 3.5% by weight, the remainder of said material being substantially iron.

5. Adamite roll material for production of a roll produced by centrifugal casting process, which consists of carbon in the range of from 1.4% to 3.0% by weight, silicon in the range of from 0.4% to 1.5% by weight, manganese in the range of from 0.4% to 2.0% by weight, nickel to an amount of 4.0% by weight or less, chromium to an amount of 0.8% by weight or less, molybdenum to an amount of 2.0% by weight or less, and one or more carbide forming elements selected from vanadium, niobium, titanium, zirconium, and tungsten to a total amount in the range of from 0.5% to 3.5% by weight, the remainder of said material being substantially iron, with the proviso that (1) the total amount of carbide forming elements is proportional to the combined total amount of carbon and chromium, and (2) the total amount of carbide forming elements increases with increasing combined total amounts of carbon and chromium.

6. Adamite roll material as defined in claim 5, wherein the one or more carbide forming elements are selected from niobium, titanium, zirconium and tungsten.

* * * * *